US010961012B2

(12) United States Patent
Martinez

(10) Patent No.: US 10,961,012 B2
(45) Date of Patent: Mar. 30, 2021

(54) TAMPER RESISTANT CONTAINER AND BLANK THEREFOR

(71) Applicant: Thoro--Packaging, Corona, CA (US)

(72) Inventor: Ralph Martinez, Riverside, CA (US)

( * ) Notice: Subject to any disclaimer, the term of this patent is extended or adjusted under 35 U.S.C. 154(b) by 0 days.

(21) Appl. No.: 15/866,165

(22) Filed: Jan. 9, 2018

(65) Prior Publication Data

US 2019/0210761 A1 Jul. 11, 2019

(51) Int. Cl.

*B65D 5/32* (2006.01)
*B65D 50/04* (2006.01)
*B65D 5/38* (2006.01)

(52) U.S. Cl.

CPC ..... *B65D 5/328* (2013.01); *B65D 5/38* (2013.01); *B65D 50/04* (2013.01); *B65D 2215/02* (2013.01)

(58) Field of Classification Search

CPC ..... B65D 5/328; B65D 50/04; B65D 5/38; B65D 5/728; B65D 77/04; B65D 11/12; B65D 59/04; B65D 5/0254; B65D 7/10; B65D 9/08; A24F 9/16

USPC ..... 229/148, 125.125, 125.26, 125.19, 229/120.08, 129.1, 220, 102; 206/250, 206/468, 815; 220/345.1; 221/250

See application file for complete search history.

(56) References Cited

U.S. PATENT DOCUMENTS 2,241,660 A * 5/1941 Ford ..... A24F 27/00 206/121
2,361,984 A * 11/1944 Williamson ..... B65D 5/0005 206/264
4,280,651 A * 7/1981 Montealegre ..... A61L 9/12 229/122
4,483,095 A * 11/1984 Webinger ..... A01M 1/02 206/525
9,828,132 B2 * 11/2017 Jones ..... B65D 5/0227
2016/0251107 A1 * 9/2016 Everett ..... B65D 5/38 206/1.5

* cited by examiner

*Primary Examiner* — Christopher R Demeree
(74) *Attorney, Agent, or Firm* — Ascus IP Law, P.C.; Colin Rasmussen

(57) ABSTRACT

A container comprising an insert and a sleeve which encloses the insert is disclosed. A blank of resilient sheet material comprising a first, second, third and fourth sequential adjoining rectangular panels are folded along their three shared side edges to form the sleeve having a rectangular cross-section, with a locking tab adjoining the first rectangular panel. An insert having a rectangular cross-section slightly smaller than the sleeve cross-section, and a mating locking tab are configured such that when the front end of the insert is substantially inserted into the front end of the sleeve, the back edges of the sleeve locking tab and the insert locking tab abut one another such that the insert may be removed only upon application of pressure at opposed locations on the exterior of the sleeve to cause the sleeve to bow outward and away from the insert.

3 Claims, 5 Drawing Sheets

TAMPER RESISTANT CONTAINER AND BLANK THEREFOR

FIELD OF THE INVENTION

The present invention relates to a container comprising a sleeve with a sliding insert which allows access to contents only when properly manipulated. The present invention relates to a controlled-access package for child resistant storage of medicinal products or the like. The package is provided with a locking function preventing a child from getting access to the product inside the package. The package can be opened and closed numerous times and then finally disposed of.

BACKGROUND OF THE INVENTION

Many containers do not provide controlled access to the materials contained therein, particularly when in the presence of children.

SUMMARY OF PARTICULAR EMBODIMENTS OF THE INVENTION

The present invention, in one embodiment, provides a container formed from two sheets of cardboard or other sheet material, comprising a sleeve with a sliding insert. The sliding insert has an end opening which is inserted into and enclosed by the sleeve, such that access to the contents can be obtained only upon the application of pressure by the user at appropriate opposed locations on the exterior of the sleeve. The sleeve comprises a sleeve locking tab on the interior of one of the major walls, which is configured to abut and retain a corresponding insert locking tab on the corresponding outer surface of the proximate major wall of the insert. Thus, the insert is prevented from sliding out of the sleeve unless the sleeve locking tab is moved away from the insert locking tab so that sliding movement is made possible.

In operation by the adult user, the sleeve locking tab is moved away from the insert locking tab by an outward bowing elastic deformation of the part of the sleeve proximate the sleeve locking tab, such that the sleeve locking tab is moved away from the insert locking tab. This outward bowing elastic deformation of the part of the sleeve proximate the sleeve locking tab is the result of the user applying an inward squeezing pressure upon the opposing outer surfaces of the two minor walls of the sleeve, proximate the sleeve locking tab and the insert locking tab.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings.

Corresponding reference characters indicate corresponding parts throughout the several views of the drawings.

Figure 1:
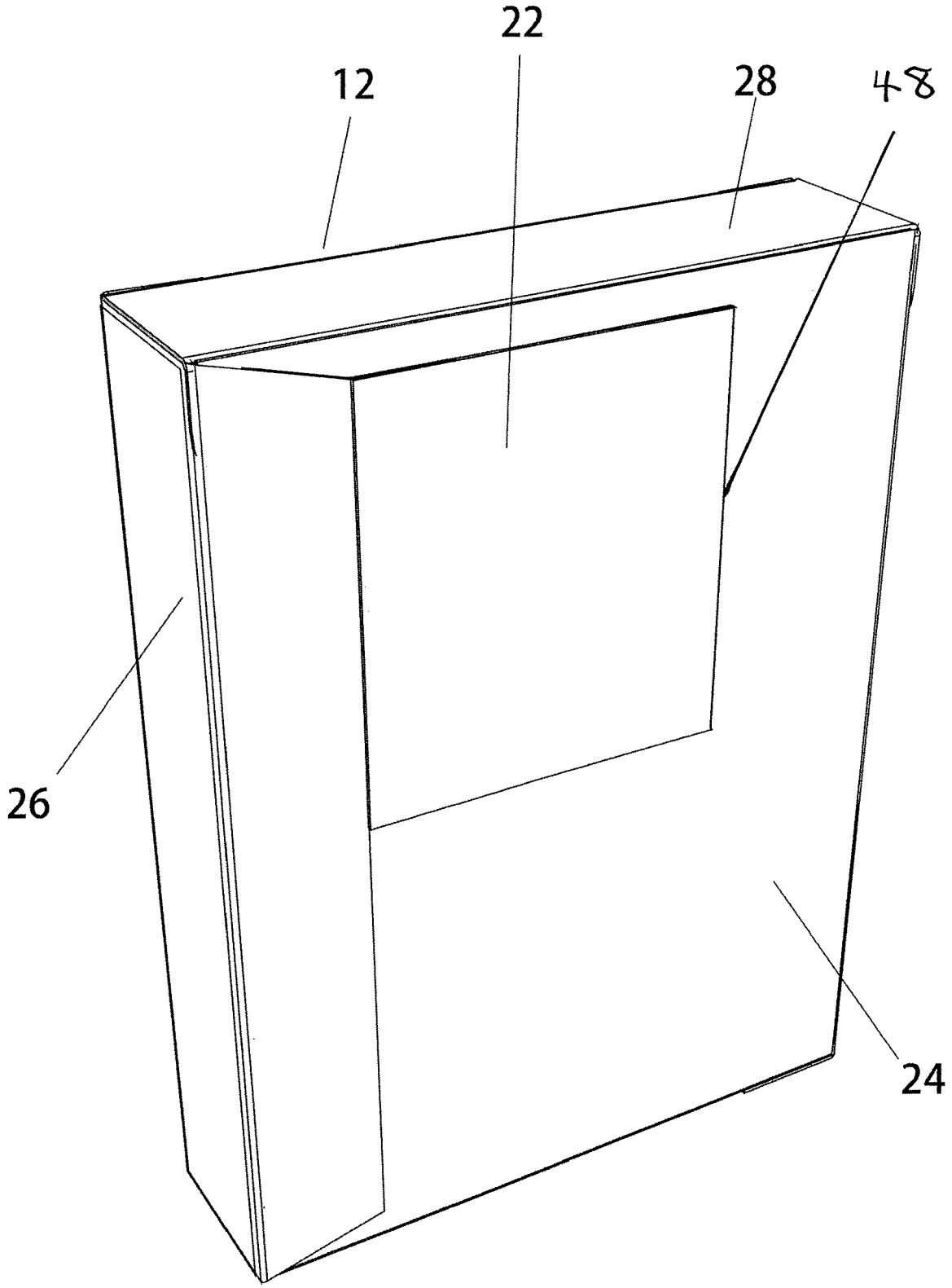
FIG. 1 is a front perspective view of the insert 12 showing the insert locking tab 22.

The drawings illustrate, among other things, various examples of embodiments of the invention, and certain examples of characteristics thereof. Other embodiments may differ. Different embodiments of the invention include various combinations of elements or acts shown in the drawings, described herein, known in the art, or a combination thereof, for instance.

DETAILED DESCRIPTION OF A PREFERRED EMBODIMENT

Referring to FIGS. 1-4, according to one embodiment of the present invention, there is shown an insert 12 which may be engaged with the sleeve 14 to form a container 10.

Figure 2:
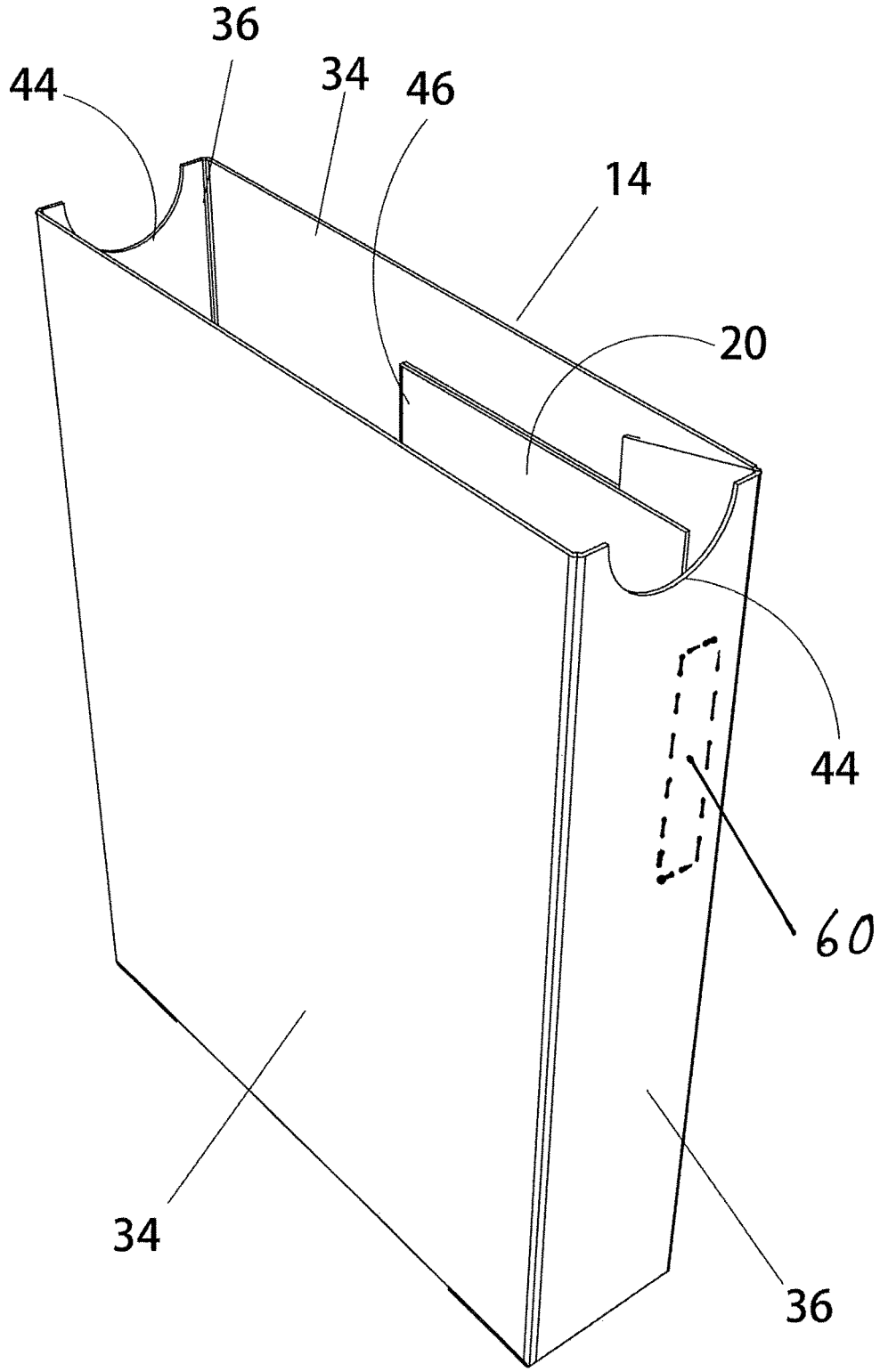
FIG. 2 illustrates a side perspective view of the sleeve 14 showing the sleeve locking tab 20.

FIG. 1 is a perspective view showing the insert 12 of the container 10 which may be engaged with the sleeve 14. As shown in FIG. 2, the container 10 also comprises an outer sleeve 14 which encloses and provides structural support for insert 12, which is slidably enclosed within sleeve 14. Semi-circular cutouts 44 on the front edges of the minor walls 36 of the sleeve 14 allow easy grasping by the user to slide the insert 12 outside of the sleeve 14 for access to its contents through opening 28 at the enclosed end of the sleeve 14. Alternatively, the insert 12 can be sized such that the front end of the insert, including front wall 22, remains outside the sleeve 14 for easy grasping by the user to slide the insert 12 outside of the sleeve 14 for access to its contents through opening 28 at the enclosed end of the sleeve 14. In operation, the opening end 28 of insert 14 is inserted into the sleeve 14 with the insert locking tab 22 proximate and sliding over the sleeve locking tab 20, thus engaging the insert locking tab 22 with the sleeve locking tab 20 in the fully inserted position. In the alternative configuration illustrated in FIG. 5, an end wall is formed to cover opening 28 with a folded flap formed from folding flaps 52 and 54. This end wall also provides additional structural rigidity for insert 12.

The blank for sleeve 14 is preferably formed from a paper-based packaging material. The packaging material may be provided with a polymer coating. This coating will make the material more tear-resistant and more resistant to handling by a user and it will aid in giving the packaging material a resilient spring-back function. The fold lines are formed by a creasing operation, which is well known in the art and will not be described in detail. In an embodiment the insert 12 is formed from a similar material. As will be described later the spring-back function is a relevant feature especially when it comes to designing the sleeve 14. The sleeve 14 and/or the insert 12 may also be formed by a polymer-based material, or other resilient material. Such a resilient material may be formed in one or several layers of the same resilient material or different resilient materials.

Figure 3:
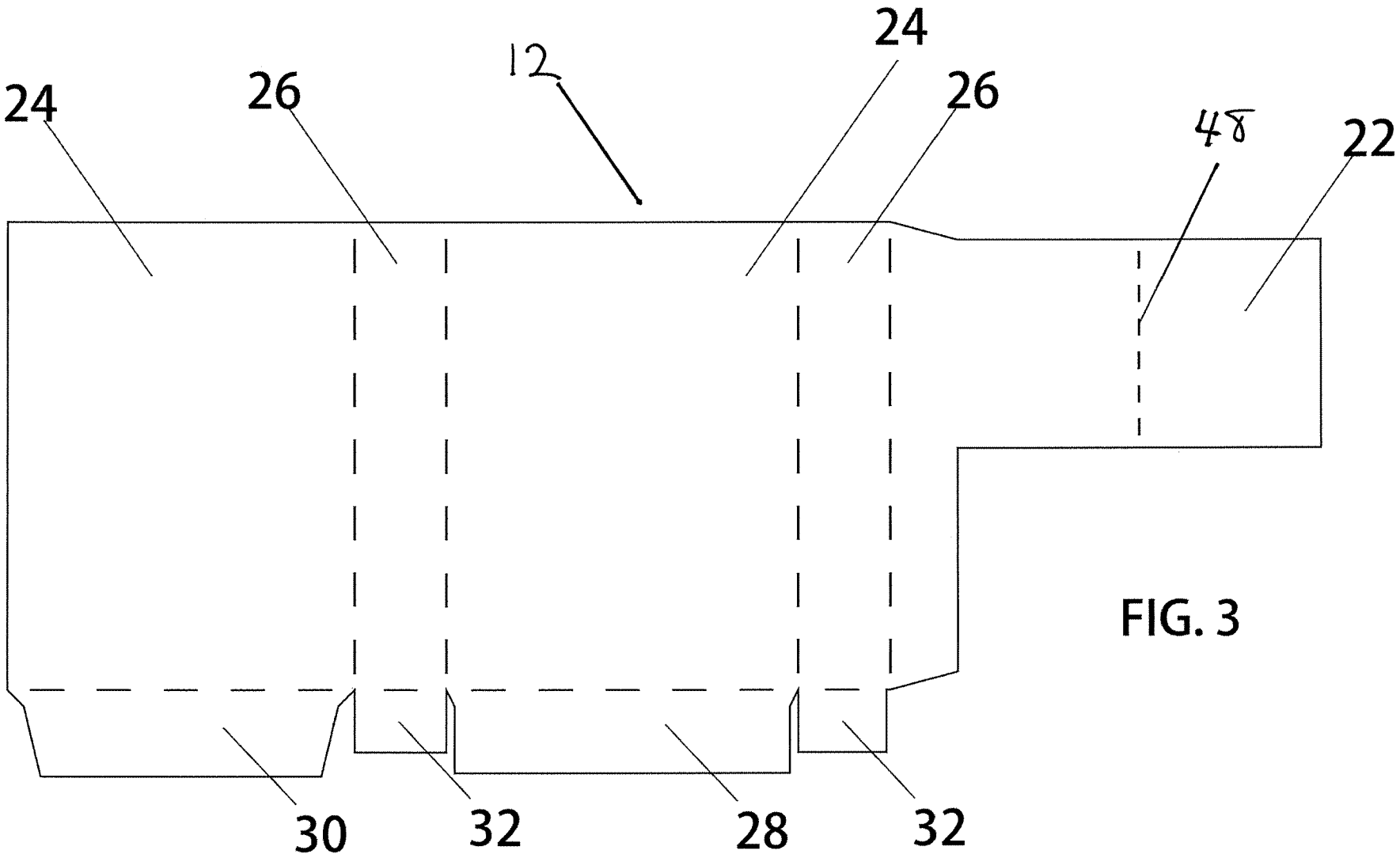
FIG. 3 illustrates a blank from which the insert 12 is formed.

As shown in FIG. 3, blank for insert 12 is folded along the dashed fold lines to form an insert 12 having a rectangular cross-section. Initially insert locking tab 22 will be folded outwardly along fold line 48 to form an insert locking tab 22 with twice the thickness of the blank. Then the blank 12 will be folded along the fold lines between the major wall panels 24 and minor wall panels 26 such that inner surface of folded insert locking tab 22 will be outside of and adhesively be attached to the exterior side of the insert major wall panel 24 at the opposite end of the blank to form the insert 12. Finally, the insert end wall panel 28 is folded over and adhered to insert end wall tab 30 and insert minor wall tabs 32 to form the closed end of the insert 12.

Figure 4:
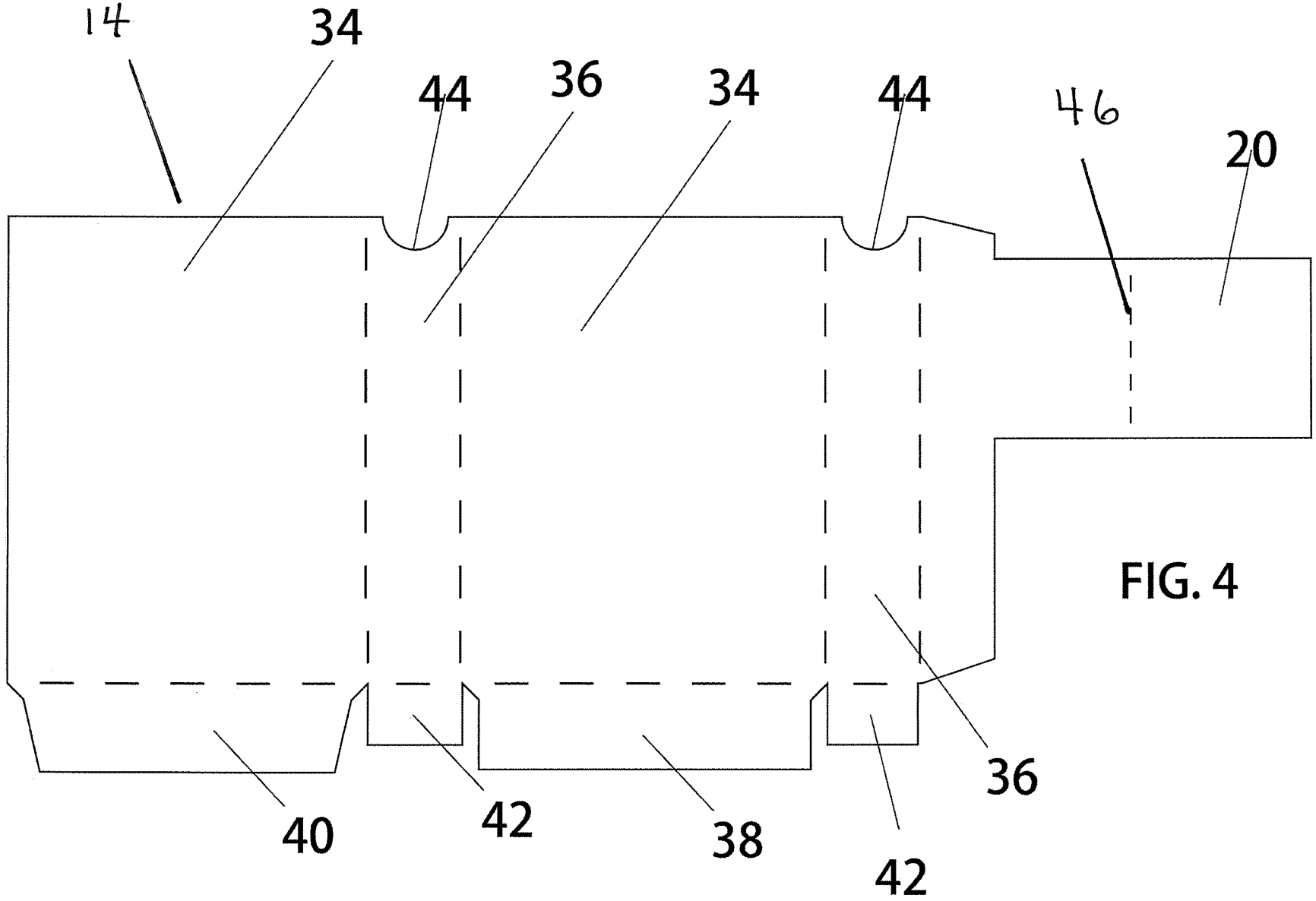
FIG. 4 illustrates a blank from which the sleeve 14 is formed.

As shown in FIG. 4, blank for sleeve 14 is folded along the dashed fold lines to form a sleeve 14 having a rectangular cross-section. Initially sleeve locking tab 20 will be folded inwardly along fold line 46 to form a sleeve locking tab 20 with twice the thickness of the blank material. Then the blank 14 will be folded along the fold lines between the major wall panels 34 and minor wall panels 36 such that outer surface of folded sleeve locking tab 20 will be inside of and adhesively be attached to the interior side of the sleeve major wall panel 34 at the opposite end of the blank to form the sleeve 14. Finally, the sleeve end wall panel 38 is folded over and adhered to sleeve end wall tab 40 and sleeve minor wall tabs 42 to form the closed end of the sleeve 14.

The end opening 28 of sliding insert 12 is inserted into and enclosed by the sleeve 14, such that access to the contents can be obtained only upon the application of pressure by the user at appropriate opposed locations 60 on the exterior minor wall panels 36 of the sleeve 14 as shown in FIG. 2. The sleeve locking tab 20 on the interior of one of the major walls 34 of the sleeve abuts and retains the corresponding insert locking tab on the corresponding outer surface of the proximate major wall 24 of the insert 12. Thus, the insert 12 is prevented from sliding out of the sleeve 14 unless pressure is applied by the user at appropriate opposed locations 60 on the exterior minor wall panels 36 of the sleeve 14, which causes the major wall 34 of the sleeve 14 with the attached sleeve locking tab 20 to bow outward such that the sleeve locking tab 20 is moved away from the insert locking tab 22 so that sliding movement of the sleeve 14 is made possible.

Figure 5:
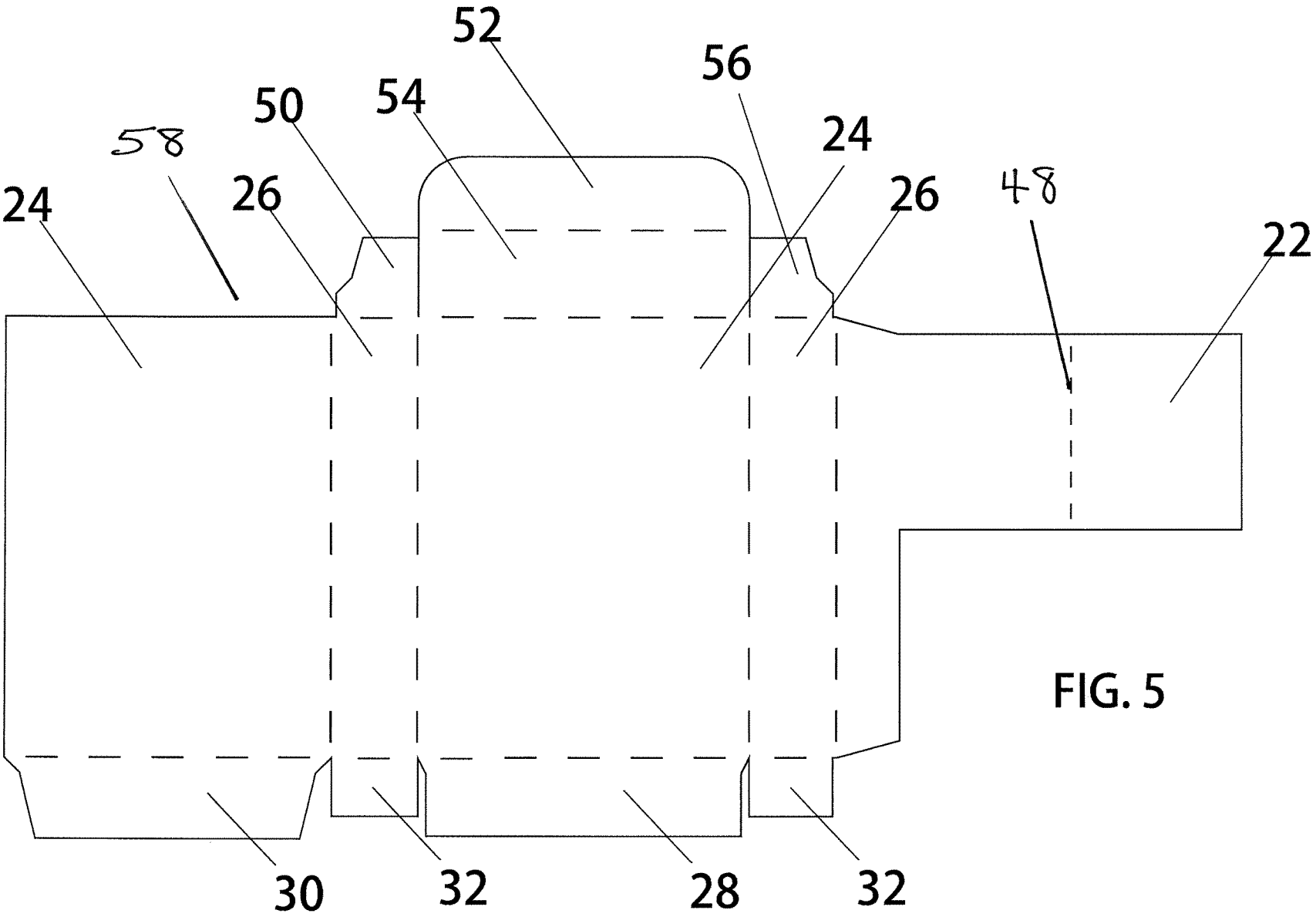
FIG. 5 illustrates a blank from which the alternative configuration insert 58 is formed.

In the alternative configuration illustrated in FIG. 5, an end wall is formed in insert 58 to foldably cover the opening with a folded flap formed from folding flaps 52 and 54 over side flaps 50 and 56, and inserting flap 52 into the interior of the insert 58 to hold the end wall in place. This folded end wall also provides additional structural rigidity for insert 12.

Thus, the present invention comprises a container in the form of an insert 12, and a sleeve 14, which snugly encloses the insert 14, both formed from blanks of foldable sheet material.

A blank of resilient sheet material 18 may be folded and assembled into a sleeve 14 having an opening at the front end, the blank 18 comprising a first, second, third and fourth sequential adjoining rectangular panels 36, 34, 36 and 34 folded along their three shared side edges to form the sleeve 14 having a rectangular cross-section, a locking tab 20 adjoining the first rectangular panel 36 along a non-shared side edge, the locking tab 20 which may be folded along the side edge to overlap and be secured to the inner surface of the fourth rectangular panel 34 and which may be folded back upon itself at 46 to form a locking tab having a double material thickness with a back edge substantially perpendicular to the shared side edges; and A blank of sheet material 16 may be folded and assembled into an insert 12 having an opening at the front end 28, the blank 16 comprising a first, second, third and fourth sequential adjoining rectangular panels 26, 24, 26 and 24 folded along their three shared side edges to form the insert 12 having a rectangular cross-section slightly smaller than the sleeve cross-section, a locking tab 22 adjoining the first rectangular panel 26 along a non-shared side edge, the locking tab which may be folded along the side edge to overlap and be secured to the outer surface of the fourth rectangular panel 24 and which may be folded back upon itself at 48 to form a locking tab having a double material thickness with a back edge substantially perpendicular to the shared side edges.

The sleeve locking tab and the insert locking tab are configured such that when the front end of the insert is substantially inserted into the front end of the sleeve with the outer surface of the fourth rectangular panel 24 of the insert proximate the inner surface of the fourth rectangular panel 34 of the sleeve, the back edges of the sleeve locking tab 20 and the insert locking tab 22 abut one another such that the insert may be removed only upon application of pressure at opposed locations 60 on the exterior of the first and third rectangular panels of the sleeve 36 and 36 proximate the sleeve locking tab to cause the fourth rectangular panel 34 of the sleeve to bow outward and away from the insert 12.

The sleeve 14 of container 10 may also have panels 38, 40, 42 and 42 adjoining the rectangular panels along the back edge which may be folded to enclose the back end of the sleeve.

The insert 12 of container 10 may also have panels 28, 30, 32 and 32 adjoining the rectangular panels along the back edge which may be folded to enclose the back end of the sleeve.

The insert 12 of container 10 may also have panels 52, 54, 50 and 56 adjoining the rectangular panels along the front edge which may be folded to enclose the front end of the sleeve.

While this invention has been described as having preferred designs, it will be understood that it is capable of further modification. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. A tamper resistant container, comprising:

a sleeve blank, the sleeve blank comprising:

first, second, third and fourth sleeve panels, each sleeve panel separated from adjacent sleeve panels by a foldable seam;

wherein the first sleeve panel further comprises a foldable first sleeve end closure, the second sleeve panel comprises a foldable first sleeve end closure tab, the third sleeve panel comprises a foldable second sleeve end closure, and the fourth sleeve panel comprises a foldable second sleeve end closure tab and a foldable sleeve locking tab;

wherein when folded along each of the foldable seams, the sleeve blank is configured to be formable into a sleeve tube having an open end and a closed end, and wherein the sleeve locking tab is completely enclosed within the interior of the sleeve tube;

an insert blank, the insert blank comprising:

first, second, third and fourth insert panels, each insert panel separated from adjacent insert panels by a foldable seam;

wherein the first insert panel further comprises a foldable first insert end closure, the second insert panel comprises a foldable first insert end closure tab, the third insert panel comprises a foldable second insert end closure, and the fourth insert panel comprises a foldable second insert end closure tab and a foldable insert locking tab;

wherein when folded along each of the foldable seams, the insert blank is configured to be formable into a insert tube having an open end and a closed end, and wherein the insert locking tab is located on the exterior of the insert tube;

wherein the insert tube is sized and shaped such that it can be inserted into the open end of the sleeve tube, wherein when substantially the entire length of the insert tube is inserted into the sleeve tube, an edge of the insert locking tab engages an edge of the sleeve locking tab, such that when the edge of the insert locking tab and the edge of the sleeve locking tab are engaged, the insert is prevented from being removable from the sleeve, thus resulting in a tamper resistant container;

wherein in the tamper resistant container thus assembled, both the sleeve locking tab and insert locking tab are located within the interior of the tamper resistant container and not exposed to an exterior of the tamper resistant container; and wherein the sleeve locking tab and insert locking tab are further configured to be disengaged by simultaneous application of a force to the second and fourth sleeve panels, the force sufficient to result in flexion of the sleeve effective to disengage the sleeve locking tab from the insert locking tab.

2. The tamper resistant container of claim 1, further comprising an adhesive applied to at least one of the first sleeve panel, the first sleeve end closure, the first sleeve end closure tab, the fourth sleeve panel, the second sleeve end closure, the second sleeve end closure tab and the sleeve locking tab, the adhesive thus applied being effective to maintain the sleeve in a desired folded configuration.

3. The tamper resistant container of claim 1, further comprising an adhesive applied to at least one of the first insert panel, the first insert end closure, the first insert end closure tab, the fourth insert panel, the second insert end closure, the second insert end closure tab and the insert locking tab, the adhesive thus applied being effective to maintain the insert in a desired folded configuration.

* * * * *